US007522120B2

(12) United States Patent
Min

(10) Patent No.: US 7,522,120 B2
(45) Date of Patent: Apr. 21, 2009

(54) ANTENNA APPARATUS OF MOBILE COMMUNICATIONS TERMINAL AND OPERATION METHOD THEREOF

(75) Inventor: Kyung Ho Min, Gyeonggi-Do (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 11/217,237

(22) Filed: Sep. 1, 2005

(65) Prior Publication Data

US 2006/0050007 A1 Mar. 9, 2006

(30) Foreign Application Priority Data

Sep. 7, 2004 (KR) ..... 10-2004-0071265

(51) Int. Cl.
*H01Q 3/24* (2006.01)

(52) U.S. Cl. ..... 343/876; 343/702; 342/149

(58) Field of Classification Search ..... 343/702, 343/876; 342/149, 374
See application file for complete search history.

(56) References Cited

U.S. PATENT DOCUMENTS

| | | | | |
|---|---|---|---|---|
| 6,456,257 | B1 * | 9/2002 | Zamat | 343/876 |
| 6,750,810 | B2 * | 6/2004 | Shinoda et al. | 342/149 |
| 2004/0041734 | A1 * | 3/2004 | Shiotsu et al. | 343/702 |
| 2004/0164905 | A1 | 8/2004 | Tran | |
| 2004/0214605 | A1 * | 10/2004 | Zhang et al. | 455/562.1 |

FOREIGN PATENT DOCUMENTS

| | | | |
|---|---|---|---|
| CN | 1390372 | | 1/2003 |
| EP | 1193797 | A2 | 4/2002 |
| EP | 1193797 | A3 | 4/2002 |
| GB | 2335798 | A | 9/1999 |
| JP | 06-311067 | | 11/1994 |
| JP | 09-191210 | | 7/1997 |
| JP | 2000236209 | | 8/2000 |
| JP | 2003-169008 | | 6/2003 |
| JP | 2003-298334 | | 10/2003 |
| JP | 2004-096341 | | 3/2004 |
| WO | 9941830 | | 8/1999 |
| WO | WO 01/31732 | A1 | 5/2001 |

* cited by examiner

*Primary Examiner*—Tho G Phan
(74) *Attorney, Agent, or Firm*—Lee, Hong, Degerman, Kang & Waimey

(57) ABSTRACT

An antenna apparatus for a mobile communications terminal and its operation method in which the length of an antenna can be varied according to the changes in the usage environment. The antenna requires minimal space for installation, and can support multiplexing of frequency bands, such as tri-band or quad-band capabilities, so as to reduce the deterioration of signal transmission and reception sensitivity caused by changes in the usage environment, such as effects from the user's hand that holds the terminal, an act of opening and closing of a folder portion of the terminal, and the like.

23 Claims, 4 Drawing Sheets

ANTENNA APPARATUS OF MOBILE COMMUNICATIONS TERMINAL AND OPERATION METHOD THEREOF

CROSS-REFERENCE TO RELATED APPLICATIONS

This application claims the benefit of earlier filing date and right of priority to Korean Application No. 10-2004-0071265, filed on Sep. 7, 2004, respectively, the contents of which is hereby incorporated by reference herein in its entirety.

BACKGROUND OF THE INVENTION

1. Field of the Invention

The present invention relates to a mobile communications terminal, and particularly, to an antenna apparatus and an operation method thereof capable of actively coping with changes in the usage environment and the communications environment of a mobile communications terminal.

2. Background of the Related Art

In general, mobile communications terminals are being implemented with various types of antennas, namely, internal antennas or external antennas so as to acquire better quality in communications according to a communications environment.

FIG. 1 illustrates a related art internal antenna structure used in mobile communications terminals (hereinafter, referred to as just 'terminal') (e.g., a CDMA terminal, a GSM terminal, relatively small-sized handsets, etc.).

Referring to FIG. 1, an internal antenna 101 is installed at a particular upper space within a terminal, and connected to a Radio Frequency (RF) circuit via a matching circuit 102.

Similar to an external antenna, the internal antenna 101 is designed to allow communications with optimal performance at a designated frequency band (i.e., a transmission/reception band). The internal antenna 101 is advantageous considering the design (i.e., the appearance or aesthetics) of a terminal, but requires addition space (room or area) to allow installation within the terminal. That is, the required length of the internal antenna 101 (i.e., the "electrical" length, namely, the overall length of the entire antenna that is required for properly handling the transmitting and receiving of signals) must be made differently according to the particular frequency at which the terminal uses to operate. As a result, the space required for the internal antenna installation is determined according to a frequency band of the terminal. For example, a greater antenna length is required as the frequency band becomes smaller, and thus, the overall size of the internal antenna 101 should be increased in its design.

Many terminals being currently developed and released that support dual-band or multi-band frequency operation need to operate at various frequency bands, and thus the required space (room or area) to install the internal antenna 101 in such terminals is much greater than that of a terminal operating at a single frequency band.

However, the performance of an internal antenna is decreased by more than 2~3 dB when compared with that of an external antenna, because of its limited installation space within the terminal and due to the operation environment of the terminal. In particular, although recent trends require the implementing of frequency band multiplexing capabilities (e.g., tri-band, quad-band, etc.) into a terminal, there are many difficulties in implementing such features into a terminal having an internal antenna when compared with a terminal having an external antenna. This is because it is difficult to ensure sufficient space around the internal antenna, and interference from the user's hand during usage occur more frequently when using a terminal having an internal antenna compared with a terminal having an external antenna.

Furthermore, in addition to the performance aspects of the terminal, because the internal antenna is installed within the terminal, the overall size of the terminal itself needs to be increased by an area required to accommodate the internal antenna. To overcome these problems, in the related art terminals having an internal antenna, several circuits need to be removed in order to provide enough space to install the internal antenna or the internal antenna design must be improved in order to reduce the overall size of the terminal.

BRIEF DESCRIPTION OF THE INVENTION

Therefore, an object of the present invention is to provide an antenna apparatus and operation method thereof capable of reducing the deterioration of signal transmission/reception characteristics by varying an electrical length of an antenna according to changes in a usage environment of a mobile communications terminal.

Another object of the present invention is to provide an antenna apparatus capable of supporting multi-band frequencies by installing two types of antennas in the mobile communications terminal and selecting an optimal antenna thereof according to an operation frequency band.

Accordingly, still another object of the present invention is to provide a mobile communications terminal capable of minimizing the deterioration of signal transmission/reception characteristics according to changes in a user environment and/or a communications environment and implementing a multi-band support capability.

To achieve these and other advantages and in accordance with the purpose of the present invention, as embodied and broadly described herein, there is provided an antenna apparatus of a mobile communications terminal comprising: an antenna unit; and a controller for adjusting physical characteristics of the antenna unit according to changes in signal transmission and reception qualities of a mobile communications terminal or according to a desired operation frequency band.

In one embodiment, the antenna unit comprises: a main antenna portion; and one or more sub-antenna portions that are allowed to be selectively connected to the main antenna portion, wherein the controller adjusts the physical characteristic of the antenna unit by selecting either the main antenna portion or the main antenna portion together with the one or more sub-antenna portions connected thereto according to changes in signal transmission or signal reception.

Preferably, the sub-antenna portion is provided with at least one or more antennas which are connected to one another in series and have the same length, or connected to one another in parallel and have different lengths.

In a different embodiment, the antenna unit comprises: a first antenna used to transmit and receive signals of a first frequency band; and one or more second antennas used to transmit and receive signals of a second frequency band, wherein the controller adjusts the physical characteristic of the internal antenna unit by selecting either the first antenna or the one or more second antennas according to the desired operation frequency band.

Preferably, the physical characteristic of the antenna unit is associated with at least one of an antenna length or an antenna type.

Preferably, the second antenna is either a chip type antenna or a loop type antenna, each being installed around the first antenna or within the mobile communications terminal.

To achieve these and other advantages and in accordance with the purpose of the present invention, there is provided an antenna operation method in a mobile communications terminal provided with a first antenna and at least one or more second antennas comprising: measuring a transmission/reception quality of the first antenna; connecting the first antenna with the at least one or more second antennas, and thus detecting an antenna combination for obtaining an optimal transmission/reception quality; and adjusting the length of an antenna according to the detected antenna combination.

Preferably, the antenna operation method in the mobile communications terminal further comprises, when the transmission/reception quality is lowered less than a threshold value, re-detecting an antenna combination capable for obtaining an optimal transmission/reception quality and re-adjusting the length of the antenna.

Preferably, the at least one or more second antennas can be antennas which are connected to one another in series and have the same length, or connected to one another in parallel and have different lengths.

The transmission/reception quality can be a Received Signal Strength Indicator (RSSI) or a Bit Error Rate (BER).

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, an explanation of some preferred embodiments of the present invention, examples of which are illustrated in the accompanying drawings, will be provided.

The present invention proposes an antenna apparatus and its operation method capable of reducing the deterioration of signal transmission and reception sensitivity due to changes in various usage environments, such as the effects caused by the user's hand holding the terminal, an act of opening and closing a folder portion of the terminal, and the like, and thus capable of providing optimal performance of the mobile communications terminal.

The present invention also proposes an antenna apparatus which requires minimal installation space and simultaneously supports a capability of multiplexing different frequency bands (e.g., tri-band, quad-band, etc) by employing an internal antenna. To achieve this, the present invention can vary a length (i.e., an electrical length) of an internal antenna or a different type antenna is selected according to the changes in a usage environment (i.e., changes in a transmission/reception qualities) or changes in a communications environment (i.e., changes in operation frequency bands) of the mobile communications terminal. Accordingly, the deterioration of signal transmission and reception characteristics of the mobile communications terminal can be reduced and/or multi-band capabilities can be supported. Preferably, varying the electrical length of the antenna and selectively using different types of antennas can be performed simultaneously or independently according to the user's selection.

Figure 1:
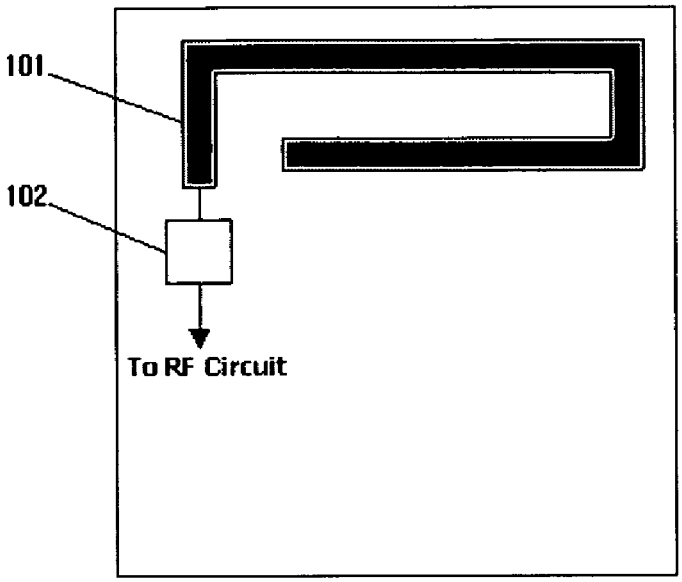
FIG. 1 Related Art
FIG. 1 is an exemplary view showing a structure of a related art internal antenna of a mobile communications terminal.
Figure 2:
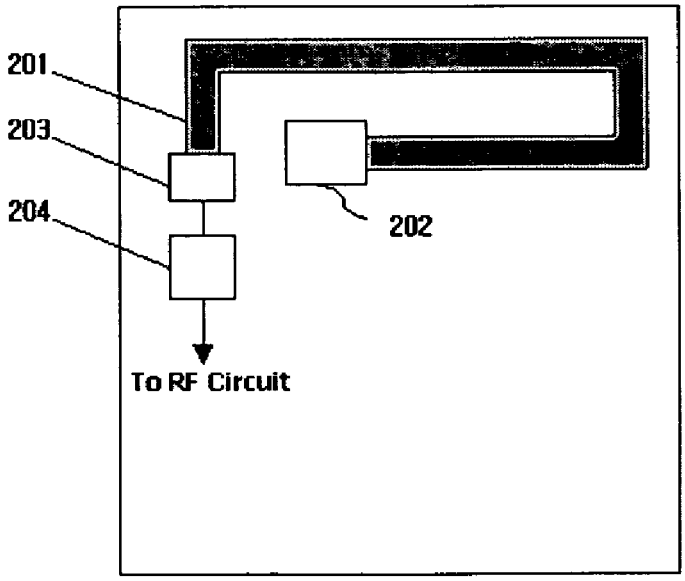
FIG. 2 is a view illustrating a construction of an antenna apparatus of a mobile communications terminal according to the present invention.

FIG. 2 is a view illustrating a construction of an antenna apparatus of a mobile communications terminal according to the present invention.

As illustrated in FIG. 2, an antenna apparatus of a mobile communications terminal according to the present invention can include: a main antenna 201 having a fixed length (i.e., a fixed "electrical" length, namely, the overall length of the entire antenna that is required for properly handling the transmitting and receiving of signals); and an antenna length adjustor 202 connected to one side of the main antenna 201 (or an end portion or any other appropriate portion thereof) used for connecting at least one or more sub-antennas to the main antenna 201 according to changes in transmission/reception qualities (or changes in the surrounding communications environment) of the mobile communications terminal, and thus varying a length (i.e., an electrical length) of the entire antenna that includes the main antenna 201. Preferably, the lengths of the sub-antennas are shorter than that of the main antenna 201.

Furthermore, the antenna apparatus of the mobile communications terminal according to the present invention may further include an antenna switching unit 203 connected between the other side of the main antenna 201 (or an opposing end portion or other appropriate portion thereof) and a matching circuit 204 when a multi-band capability is supported, for selecting an optimal antenna among the main antenna and the sub-antennas according to an operation frequency band.

Figure 3:
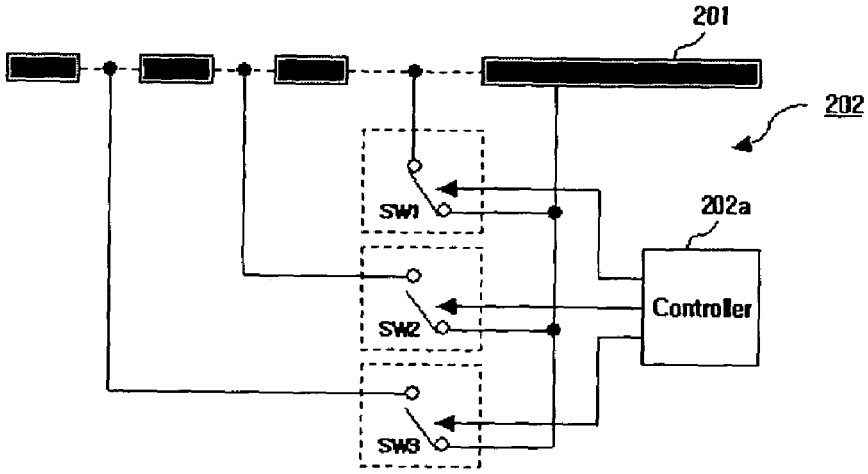
FIG. 3 is a view illustrating a first embodiment of an antenna length adjustor shown in FIG. 2.

FIG. 3 is a view illustrating a first embodiment of the antenna length adjustor 202. The antenna length adjustor 202 may include: the main antenna 201; at least one or more sub-antennas, each of which having the same length and is serially connected to one another; a plurality of switches SW1, SW2, SW3, . . . , for selectively connecting each sub-antenna to the main antenna 201; and a controller 202*a* for controlling an operation of each switch according to the surroundings (e.g., the communications environment) to thus vary the electrical length of the entire antenna that includes the main antenna 201.

Figure 4:
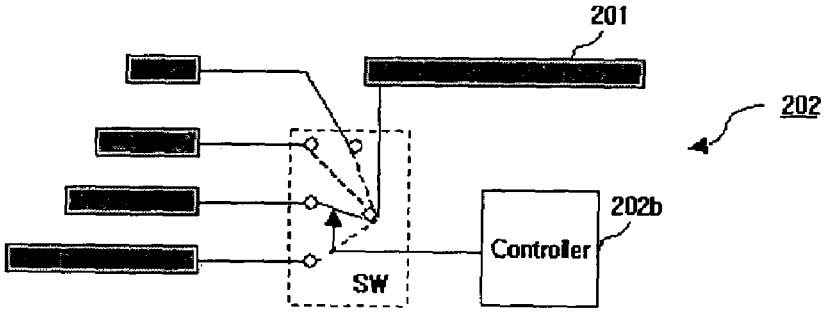
FIG. 4 is a view illustrating a second embodiment of the antenna length adjustor shown in FIG. 2.

FIG. 4 is a view illustrating a second embodiment of the antenna length adjustor 202. The antenna length adjustor 202 can include: the main antenna 201; at least one or more sub-antennas, each of which having a different length and is connected to one another in parallel; a switch SW for selectively connecting each sub-antenna to the main antenna 201; and a controller 202*b* for controlling the operation of the switch SW according to the surroundings (e.g., the communications environment) to thus varying the electrical length of the entire antenna that includes the main antenna 201.

As shown in FIGS. 3 and 4, the controller 202*a* or 202*b* can control the appropriate switches or switch according to the transmission/reception quality (or the surroundings (environment)) of the mobile communications terminal and thus varies the electrical length of the main antenna 201. Here, when the electrical length of the main antenna is changed, a change of a resonant frequency is created. Also, the resonant frequency of the antenna is generally changed according to the usage environment of the mobile communications terminal. Accordingly, the mobile communications terminal may not function with optimal characteristics during actual use in contrast to the conditions that were used when designing the terminal, due to reasons such as, the particular environment in which the mobile communications terminal is operating in, the particular manner by which the user holds the mobile communications terminal, the conditions when the folder portion is opened or closed (for a folder-type mobile terminal), or the like.

Thus, as shown in FIGS. 3 and 4, if the length of the antenna is varied appropriately according to changes in the surroundings (or changes in the transmission/reception quality) of the mobile communications terminal, an optimal antenna characteristic can be implemented to thusly minimize any deterioration in signal transmission and reception sensitivity.

Figure 5:
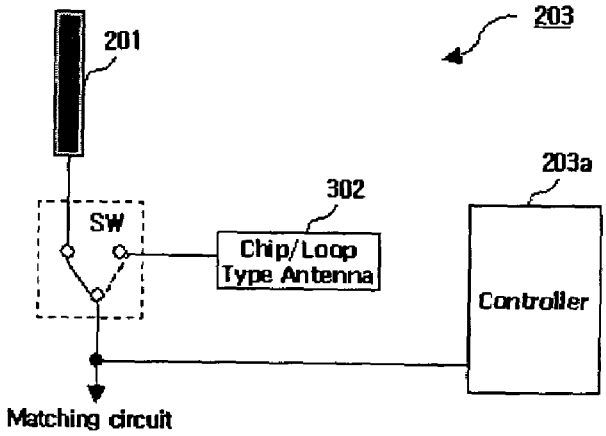
FIG. 5 is a detailed view illustrating a construction of an antenna switching unit in FIG. 2.

FIG. 5 is a detailed view illustrating an exemplary construction of the antenna switching unit 203. The antenna switching unit 203 shown in FIG. 4 can include: the main antenna 201; a separate antenna 301 for supporting particular frequency bands (e.g., GSM 850, PCS, etc); a switch SW for connecting the main antenna 201 or the separate antenna 301 to a matching circuit (204 of FIG. 2); and a controller 203*a* for controlling an operation of the switch SW according to the operation frequency band of the mobile communications terminal. One or more separate antennas 301 can be provided, so as to implement tri-band or quad-band capabilities. Preferably, the separate antennas 301 are various types of antennas, for instance, a so-called "chip type antenna" or a "loop type antenna", for transmitting and receiving another frequency band signal with the main antenna 201.

That is, the antenna switching unit 203 can be used to select an optimal antenna (i.e., overall antenna length) according to changes in the operation frequency band when the at least one or more separate antennas 301 are internally installed (corresponding to the main antenna and the chip type antenna in the present invention).

In general, the chip type antenna 301 has a very small size such that it can be easy to be implemented requiring minimal installation space. However, the limited characteristics of the chip type antenna causes some difficulties for implementation in a mobile communications terminal.

However, as shown in FIG. 5 of the present invention, the chip type antenna, as the separate antenna 301, can be arranged at one side of (namely, adjacent to) the main antenna 201 or at other appropriate locations within the mobile communications terminal. Thereafter, either the main antenna 201 or the chip type antenna 301 can be selected by using the switch SW, so that a mobile communications terminal supporting multi-band frequencies can be implemented. For instance, when a user of an European Global System for Mobile Communication (GSM) Dual-Band (GSM+DCS) handset travels around the North America region, the user can switch the GSM Dual-Band antenna to a chip type band antenna (GSM 850, PCS, etc) that exhibits a performance that is slightly lower than that of the GSM Dual-Band antenna, according to an antenna switching, which thus allows the user to perform communication in the corresponding region. Similarly, the tri-band or quad-band frequency capabilities can be used according to the antenna switching method of the present invention.

In addition, although separate controllers 202*a*, 202*b*, and 203*a* are respectively shown in FIGS. 3 to 5, these are just exemplary. One controller can actually output a control signal to the antenna length adjustor 202 and also to the antenna switching unit 203.

Figure 6:
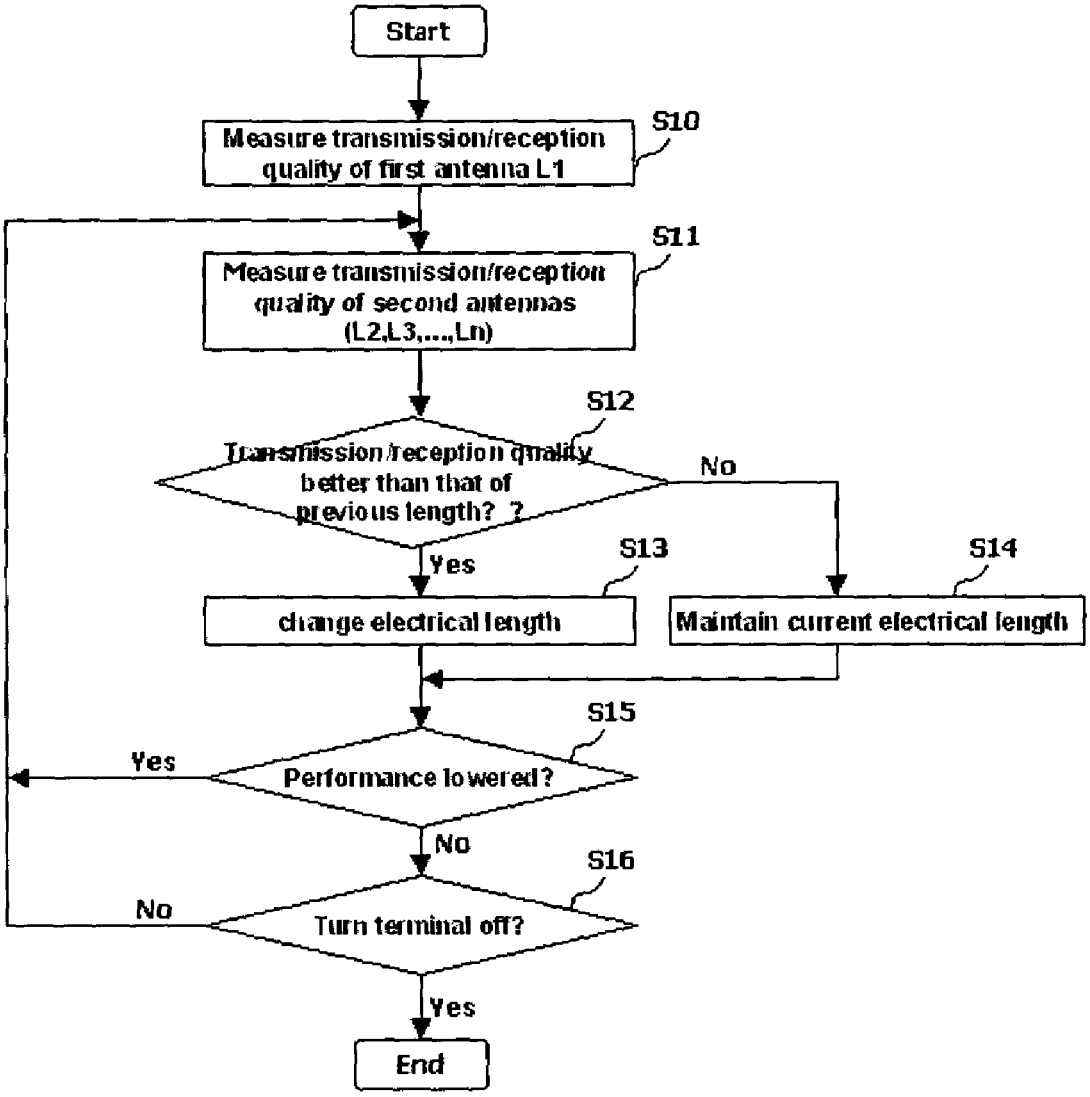
FIG. 6 is a flowchart of a first embodiment illustrating sequential steps of an antenna operation method of a mobile communications terminal according to the present invention.

FIG. 6 is a flowchart of a first embodiment showing sequential steps of an internal antenna operation method of a mobile communications terminal according to the present invention. In particular, FIG. 6 illustrates a method for varying a length of an antenna.

As illustrated in FIG. 6, when the mobile communications terminal is turned on, the controller 202*a* or 202*b* can measure a signal transmission and/or reception quality of a default antenna, namely, the main antenna (length: L1) in a state (normal state) that the mobile communications terminal currently operates under (S10). That is, the controller 202*a* or 202*b* can measure a Received Signal Strength Indicator (RSSI) or a Bit Error Rate (BER), or the like.

When the signal transmission and/or reception quality of the main antenna is measured, the controller 202*a* or 202*b*, as shown in FIG. 3 or 4, can selectively connect the main antenna with each sub-antenna in sequence, in series or in parallel (i.e., changes the lengths L2, L3, . . . , Ln of the antennas) so as to measure the signal transmission and/or reception quality (S11). According to the measurement, when the signal transmission and/or reception quality (measured in Step S11) is better than the previous measurement, the length of the antenna is changed, while the length of the antenna is not changed when the current measurement is not better than the previous measurement (S12 to S14). That is, the controller 202*a* or 202*b* connects the main antenna with each sub-antenna in sequence and detects an antenna combination for which the signal transmission and/or reception quality can be optimally obtained. Thereafter, the controller 202*a* or 202*b* regulates the length of the antenna according to the detected antenna combination.

Afterwards, while the mobile communications terminal is turned on, the controller 202*a* or 202*b* can measure the signal transmission and/or reception quality during a particular time interval. When the signal transmission and/or reception quality falls under a threshold value, the controller 202*a* or 202*b* may re-detect the antenna combination in which the optimal signal transmission and/or reception quality can be obtained, so as to re-regulate (i.e., repeat the adjusting of) the length of the overall antenna. As a result, the controller 202*a* or 202*b* can maintain the optimal signal transmission and/or reception quality at any desired time (S15 and S16).

Figure 7:
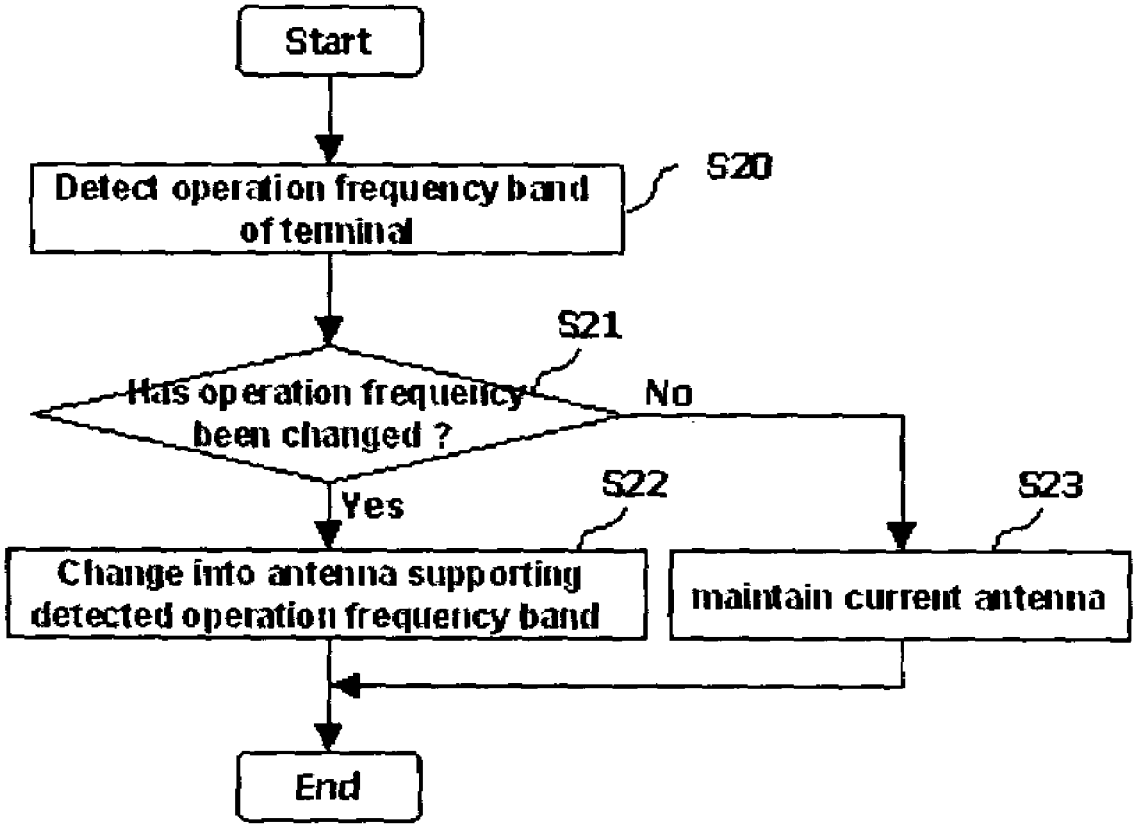
FIG. 7 is a flowchart of a second embodiment illustrating sequential steps of the antenna operation method of the mobile communications terminal according to the present invention.

FIG. 7 is a flowchart of a second embodiment illustrating sequential steps of an antenna operation method of a mobile communications terminal according to the present invention, in which a method for implementing a multi-band capability is illustrated.

For instance, when a user of an European GSM Dual-Band (GSM+PCS) handset travels around the North America region, the controller can detect changes in the operation frequency band of the mobile communications terminal (S20) by a user's selection. According to the detection, if the operation frequency band of the mobile communications terminal is changed by a user (S21), a separate antenna supporting the changed operation frequency band is connected to the matching circuit (S22). Conversely, if the operation frequency band of the mobile communications terminal is not changed, the current main antenna continues to be connected to the matching circuit (S23).

The present invention also provides an antenna apparatus comprising: an antenna unit within the mobile communication terminal; and a controller for adjusting a physical characteristic of the antenna unit according to changes in signal transmission or signal reception, or according to a desired operation frequency band.

In one embodiment, the antenna unit comprises: a main antenna portion; and one or more sub-antenna portions that are allowed to be selectively connected to the main antenna portion, wherein the controller adjusts the physical characteristic of the antenna unit by selecting either the main antenna portion or the main antenna portion together with the one or more sub-antenna portions connected thereto according to changes in signal transmission or signal reception.

In a different embodiment, the antenna unit comprises: a first antenna used to transmit and receive signals of a first frequency band; and one or more second antennas used to transmit and receive signals of a second frequency band, wherein the controller adjusts the physical characteristic of the antenna unit by selecting either the first antenna or the one or more second antennas according to the desired operation frequency band.

It should preferably be noted that the physical characteristic of the antenna unit can be associated with at least one of an antenna length and an antenna type. Also, the features of the above two embodiments may also be combined together if desired.

As aforementioned, in the CDMA, GSM, or other small-sized mobile communications terminals according to the present invention, when a usage environment of the mobile communications terminal changes, the length of the antenna is varied by connecting separate sub-antennas, which results in a reduction of the deterioration in the signal transmission and/or reception characteristics.

In addition, the present invention can effectively support multi-band frequency capabilities by selecting an optimal antenna length according to an operation frequency band by providing more than two types of antennas in the mobile communications terminal that can be selectively used.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An antenna apparatus of a mobile communications terminal comprising:

a first antenna;

one or more second antennas;

one or more third antennas used to transmit and receive frequency band signals which are different frequency band signals those of the first and the one or more second antennas; and an antenna length adjustor connected to the first antenna for varying the length of the first antenna by coupling the one or more second antennas with the first antenna according to a signal transmission/reception quality of the mobile communications terminal, wherein the one or more third antennas is a chip type antenna or a loop type antenna.

2. The apparatus of claim 1, wherein the antenna length adjustor further comprises:

one or more first switches connected between the first antenna and each of the one or more second antennas; and a controller for controlling the one or more first switches according to the signal transmission/reception quality of the mobile communications terminal, and connecting the at least one or more second antennas to the first antenna.

3. The apparatus of claim 2, wherein the one or more second antennas have the same length, and are connected to one another in series.

4. The apparatus of claim 2, wherein the one or more of second antennas have different lengths, and are connected to one another in parallel.

5. The apparatus of claim 2, wherein the controller compares a transmission/reception quality of the first antenna with a transmission/reception quality measured by sequentially connecting the first antenna to each of the one or more second antennas in order to change the length of the first antenna according to an antenna combination having an optimal transmission/reception quality.

6. The apparatus of claim 1, further comprising an antenna switching unit provided with the one or more third antennas which are different from the first antenna, for selecting one of the first antenna and the one or more third antennas according to a user's selection.

7. The apparatus of claim 6, wherein the antenna switching unit comprises:

a second switch for connecting one of the first antenna and the one or more third antennas to a matching circuit; and a controller for changing the operation frequency band of the mobile communications terminal by controlling the second switch.

8. The apparatus of claim 7, wherein the one or more third antennas are installed around the first antenna or in the mobile communications terminal.

9. An antenna apparatus of a mobile communications terminal comprising:

a first antenna;

one or more second antennas;

a third antenna for supporting a particular operation frequency band used to transmit and receive frequency band signals which are different from frequency band signals of the first and the one or more second antennas;

a switching unit for connecting the first antenna with each of the one or more second antennas; and a controller for controlling an operation of the switching unit according to a signal transmission/reception quality of the mobile communications terminal to vary the length of the first antenna, wherein the third antenna is a chip type antenna or a loop type antenna.

10. The apparatus of claim 9, wherein the switching unit comprises at least one or more switches connected between the first antenna and each of the one or more second antennas.

11. The apparatus of claim 9, wherein the one or more second antennas are either connected in series and have the same length, or are connected in parallel and have different lengths.

12. The apparatus of claim 9, further comprising:

a switch for connecting either the first antenna or the third antenna to a matching circuit according to a control of the controller.

13. The apparatus of claim 12, wherein the third antenna is provided with one or more antennas, each installed around the first antenna or in the mobile communications terminal.

14. A mobile communications terminal comprising:

a first antenna;

one or more second antennas;

a third antenna for supporting a particular frequency band signal, used to transmit and receive frequency band signals which are different from frequency band signals of the first and the one or more second antennas;

one or more first switches provided between the first antenna and the one or more second antennas; and a controller for controlling the one or more first switches according to a signal transmission/reception quality to vary a length of the first antenna, wherein the third antenna is a chip type antenna or a loop type antenna.

15. The terminal of claim 14, wherein the one or more second antennas are either connected to in series and have the same length, or are connected in parallel and have different lengths.

16. The terminal of claim 14, further comprising:

a second switch for connecting the first antenna or the third antenna to a matching circuit according to a control of the controller.

17. The terminal of claim 16, wherein the third antenna is provided with one or more antennas, each installed around the first antenna or installed in the mobile communications terminal.

18. An antenna apparatus of a mobile communication terminal comprising:

an antenna unit; and a controller for adjusting a physical characteristic of the antenna unit according to changes in signal transmission, according to changes in signal reception, or according to a desired operation frequency band, wherein the antenna unit comprises:

a main antenna portion for transmitting and receiving signals of a first frequency band; and one or more sub-antenna portions for transmitting and receiving signals of a second frequency band that are selectively connected to the main antenna portion, wherein the one or more sub-antenna portions are each provided with one or more antennas either connected in series and having the same length or connected in parallel and having different lengths, and wherein the one or more sub-antenna portions are a chip type antenna or a loop type antenna.

19. The apparatus of claim 18, wherein the physical characteristic of the antenna unit is associated with at least one of an antenna length or an antenna type.

20. The apparatus of claim 18, wherein the controller adjusts the physical characteristic of the antenna unit by selecting either the main antenna portion or the main antenna portion together with the one or more sub-antenna portions connected thereto according to changes in signal transmission or signal reception.

21. The apparatus of claim 18, wherein the controller adjusts the physical characteristic of the antenna unit by selecting either the main antenna or the one or more sub-antenna portions according to the desired operation frequency band.

22. The apparatus of claim 21, wherein the one or more sub-antenna portions are installed around the main antenna.

23. The apparatus of claim 21, wherein the one or more sub-antenna portions are installed in the mobile communications terminal.

* * * * *